United States Patent [19]

Nakaoka et al.

[11] Patent Number: 4,788,573

[45] Date of Patent: Nov. 29, 1988

[54] IMAGE FORMING APPARATUS

[75] Inventors: Masaki Nakaoka; Tadashi Yagi, both of Yokohama, Japan

[73] Assignee: Canon Kabushiki Kaisha, Tokyo, Japan

[21] Appl. No.: 51,248

[22] Filed: May 15, 1987

Related U.S. Application Data

[63] Continuation of Ser. No. 735,193, May 17, 1985, abandoned.

[30] Foreign Application Priority Data

May 24, 1984 [JP] Japan ..... 59-105867

[51] Int. Cl.[4] ..... G03G 21/00

[52] U.S. Cl. ..... 355/3 CH; 250/324; 355/15

[58] Field of Search ..... 355/3 R, 3 CH, 14 CH, 355/15; 361/230; 250/324, 325

[56] References Cited

U.S. PATENT DOCUMENTS

| | | | |
|---|---|---|---|
| 3,842,273 | 10/1974 | Van Buskirk | 361/230 X |
| 3,891,846 | 6/1975 | Ito | 361/230 X |
| 3,978,379 | 8/1976 | Del Vecchio | 355/3 CH X |
| 4,455,078 | 6/1984 | Mukai et al. | 355/3 CH |
| 4,470,689 | 9/1984 | Nomura et al. | 355/3 R |
| 4,566,777 | 1/1986 | Honda et al. | 355/3 CH |

FOREIGN PATENT DOCUMENTS 58-173757 10/1983 Japan .

*Primary Examiner*—Fred L. Braun

*Attorney, Agent, or Firm*—Fitzpatrick, Cella, Harper & Scinto

[57] ABSTRACT

An image forming apparatus includes a corona discharging device having a cleaner for cleaning a corona discharging wire and is removably mountable in an operative position. Further, an image forming apparatus in which a cartridge containing therein at least a corona discharging device functioning as image formation processor is provided with a cleaner for cleaning a corona discharging wire removably mountable therein. When the corona discharging device or the cartridge is to be mounted in the image forming apparatus, and when the cleaner is not positioned at a predetermined position in the corona discharging device or at a predetermined position in the cartridge, a stopper provided on the image forming apparatus side is brought into engagement with the cleaner to thereby relatively move the cleaner to the predetermined position in the corona discharging device or the cartridge.

11 Claims, 4 Drawing Sheets

IMAGE FORMING APPARATUS

This application is a continuation of application Ser. No. 735,193 filed May 17, 1985, now abandoned.

BACKGROUND OF THE INVENTION

1. Field of the Invention

This invention relates to an image forming apparatus such as an electrophotographic apparatus or an electrostatic recording apparatus, such as a copying apparatus or a laser beam printer, and in particular to cleaning of a corona discharging device used in such image forming apparatus.

2. Description of the Prior Art

In an image forming apparatus, in order to charge or discharge an image bearing member, use has heretofore been made of a corona discharging device for applying a high voltage to a wire having a diameter on the order of 0.1 mm to thereby create corona discharge.

However, in the corona discharging device, there has been a problem that the corona discharging wire functioning as a corona discharging electrode is liable to be stained by developer and other foreign substances, and this stain causes irregularity of discharge. This in turn has led to a disadvantage that when image formation is effected with the stained corona discharging wire, the irregularity of discharge clearly appears as an irregularity in the image. Accordingly, it has been necessary to always keep the corona discharging wire stainless and clean.

So, there have heretofore been devised various methods of cleaning the corona discharging wire.

For example, there is a method in which a cleaner for contacting the corona discharging wire is securely provided on the image forming apparatus body side and the corona discharging device itself is inserted and removed with respect to the apparatus body to thereby clean the wire (see Japanese Patent Publication No. 1830/1976). However, this method has suffered from an inconvenience that when other maintenance, such as the height adjustment of the wire, is to be effected on the corona discharging device, the corona discharging device cannot be pulled out unless the cleaner is removed from the apparatus body each time.

There is also known an apparatus in which the corona discharging device itself is provided with means for cleaning the corona discharging wire by the sliding of a rod or the like (U.S. Pat. No. 3,942,006), but such an apparatus has suffered from a disadvantage that generally the apparatus becomes complicated and bulky.

On the other hand, recently, image forming apparatuses designed such that process elements such as an image bearing member, a corona discharging device, a developing device and a cleaning device which are directly concerned with image formation and particularly require sufficient maintenance are contained in a cartridge and the cartridge is interchanged instead of effecting maintenance of the individual process elements, have become popular. However, in such apparatus, in order to achieve a reduction in cost and exclude uselessness with respect also to the method of fixing each process element, there is not provided, for example, a construction for inserting and removing the corona discharging device, etc., but there is adopted the simplest possible construction in which the corona discharging device is fixed to the frame member of the cartridge as by screws. Also, basically, the cartridge is designed such that its interior cannot be touched from outside and therefore, a contrivance is necessary in respect also of the cleaning of the corona discharging wire.

With regard to the cleaning of the corona discharging wire in such image forming apparatuses, there is a device as shown in assignee's, U.S. application Ser. No. 523,365 (filed on Aug. 15, 1983), now U.S. Pat. No. 4,566,777, wherein a slit opening is formed in the cartridge frame member on the back side of the corona discharging device and a separate cleaner is inserted through this opening to clean the corona discharging wire. However, this cleaner is devised as a supplemental means for an apparatus in which the copy volume per cartridge is 2,000 to 3,000 sheets and there is relatively little stain of the corona discharging wire. For a cartridge corresponding to an apparatus of greater copy volume, it becomes necessary to clean the corona discharging wire simply and reliably.

SUMMARY OF THE INVENTION

It is an object of the present invention to provide an image forming apparatus which eliminates the above-noted disadvantages peculiar to the prior art cleaning of the corona discharging electrode.

It is another object of the present invention to provide an image forming apparatus which is excellent in operability for the cleaning of the corona discharging electrode.

Other objects and features of the present invention will become more fully apparent from the following detailed description thereof taken in conjunction with the accompanying drawings.

DESCRIPTION OF THE PREFERRED EMBODIMENTS

Some embodiments of the present invention will hereinafter be described with reference to the drawings.

Figure 1:
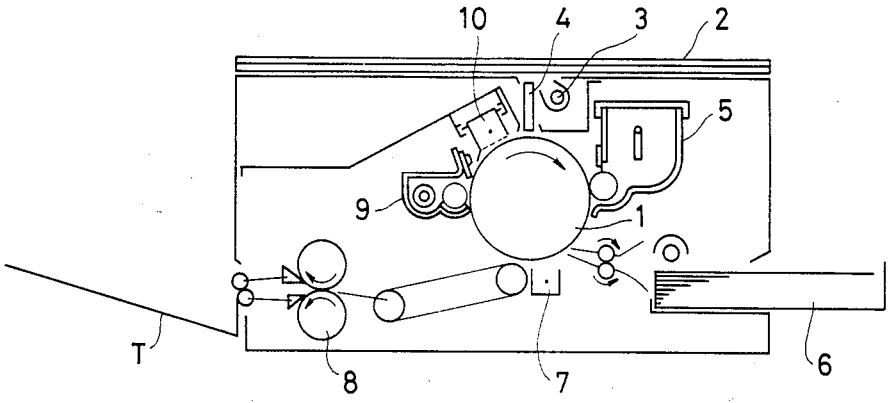
FIG. 1 is a schematic view of an image forming apparatus showing a first embodiment of the present invention.

FIG. 1 shows an electrophotographic copying apparatus as an example of the image forming apparatus.

A photosensitive drum 1 which is an image bearing member is uniformly charged by a corona discharging device 10. This corona discharging device 10 is removably mounted with respect to the body of the image forming apparatus. The details of the corona discharging device will later be described.

An original supported on an original supporting table 2 is moved while being illuminated by an original illuminating lamp 3, whereby through imaging optical means 4, a light image corresponding to the original is exposed on the uniformly charged image bearing member 1. Thereby an electrostatic latent image is formed on the image bearing member. The electrostatic latent image thus formed is developed into a visible image by a developing device 5. The visible image is transferred onto a transfer material by a transfer corona discharging device 7, the transfer material being moved thereto from a cassette 6 in timed relationship with the image bearing member by a paper feeding roller and register rollers. The transfer material having the visible image transferred thereto is separated from the image bearing member by separating means, not shown, whereafter it is conveyed to a fixing device 8 by conveying means and fixation of the image is effected there. Thereafter, the transfer material is discharged onto a tray T by paper discharging rollers.

On the other hand, any residual toner on the image bearing member is removed by a cleaning device 9 and the image bearing member is reused in the next image formation.

Figure 2:
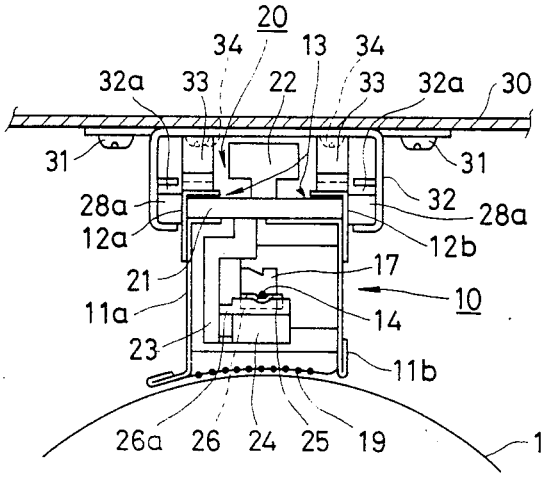
FIG. 2 is a schematic transverse cross-sectional view of the vicinity of a corona discharging device showing the first embodiment of the present invention.

The corona discharging device used in the image forming apparatus of the present invention will now be described by reference to FIGS. 2 and 3.

The corona discharging device 10 has electrically conductive shield members 11*a* and 11*b* forming an opening for corona discharge relative to the image bearing member 1 which is a member to be charged. Plate-like members 12*a* and 12*b* of L-shaped cross-section are fixed to these shield members 11*a* and 11*b*, respectively, as by spot welding, and the shield members and the plate-like members together form a guide portion 13 extending lengthwise through the corona discharging device. The slide portion 21 of a cleaner 20 is guided to the guide portion 13, and the cleaner 20 is thereby movable lengthwise relative to a corona discharging wire along the guide portion 13.

The corona discharging wire 14 has one end thereof restrained on a power supply portion 15 provided on a rear insulative supporting block 28, through a tension spring, and has the other end thereof fixed to a front insulative block 27 by a screw 16. Further, the corona discharging wire 14 is engaged with positioning members 17 provided in insulative supporting blocks 27 and 28, respectively, the positioning members 17 being vertically movable by adjusting screws 18. Accordingly, by adjusting the adjusting screws 18, the positioning members 17 can be moved and the distance of the corona discharging wire 14 from the image bearing member 1 can be set to a proper value. Reference numeral 19 designates a grid electrode for controlling the surface potential of the image bearing member 1.

The cleaner 20 will now be described. A knob portion 22 protruding toward the back side of the corona discharging device is provided on the upper portion of the slide portion 21, and an arm portion 23 is provided on the opposite side thereof. Further, a resilient arm portion 24 is attached to the arm portion 23. A cleaning portion 25 for contacting the corona discharging wire 14, which is a corona discharging electrode, and for effecting the cleaning of the corona discharging wire, and a holding member 26 for holding this cleaning portion 25 are provided on the tip end of the resilient arm portion 24. The resilient arm portion 24 is adapted to press the cleaning portion 25 against the corona discharging wire 14 with a predetermined pressure force (of the order of 100–300 g) by its resiliency when the corona discharging wire 14 is cleaned by at least said cleaning portion 25. The shape of the resilient arm portion 24 can be determined by the tension of the corona discharging wire 14 relative to the predetermined pressure force, the position adjustment range of the wire adjusted by the movement of the positioning member 17, the material of the cleaning portion 25, etc.

On the other hand, the corona discharging device 10 is removably mounted with respect to a support member 32 which itself is fixed to the frame member 30 of the image forming apparatus body by a fixing member such as a screw 31. More specifically, the projections 27*a* and 28*a* of insulative supporting blocks 27 and 28 forward and rearward of the corona discharging device are engaged with the guide rail portions 32*a* of said support member 32 so that the corona discharging device 10 can be inserted and removed by in the directions of bilateral arrow A (FIG. 3). Also, the corona discharging device 10 when in a state in which it is mounted on the apparatus body (FIG. 3) is pressed toward the image bearing member by plate springs 33 attached to said support member 32 by screws 34. The corona discharging device 10 is inserted along said support member 32, whereafter the positioning thereof with respect to the longitudinal direction (the direction of arrow A) is effected by engagement between the frame member 35 of the apparatus body and the rear insulative supporting block 28 of the corona discharging device 10. Reference numeral 29 designates a handle used to mount and dismount the corona discharging device 10 with respect to the image forming apparatus body.

A method of cleaning the corona discharging wire 14 will now be described.

Figure 3:
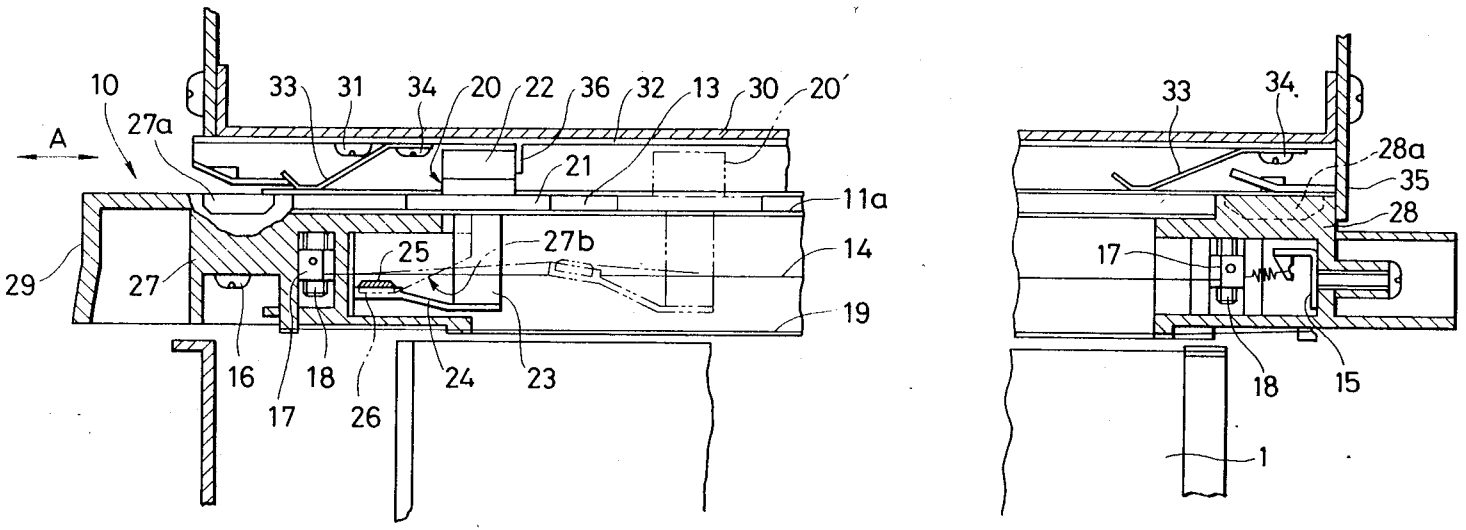
FIG. 3 is a schematic longitudinal cross-sectional view of the vicinity of the corona discharging device showing the first embodiment of the present invention.

From the state as shown in FIG. 3 wherein the corona discharging device 10 is mounted in the image forming apparatus body, the corona discharging device 10 is pulled out in the leftward direction as viewed in FIG. 3 by gripping the handle 29, whereby the corona discharging device 10 is separated from the image forming apparatus body. Thereafter, the cleaner 20 is reciprocated lengthwise relative to the corona discharging device by gripping the knob portion 22 of the cleaner 20, whereby the corona discharging wire 14 is cleaned by the cleaning portion 25.

Also, when the corona discharging device is to be mounted after the wire has been cleaned, the corona discharging device 10 is inserted into the image forming apparatus until the aforementioned rear insulative supporting block 28 strikes against the body frame 35 while the projection 28*a* of the block 28 is brought into engagement with the guide rail portion 32*a* of the support member 32. Thereby, the mounting of the corona discharging device with respect to the image forming apparatus body is completed. This position is the operative position of the corona discharging device.

Now, after the cleaning of the corona discharging wire, the corona discharging device may be mounted in the image forming apparatus with the cleaner 20 being moved to a position at the end of the insulative supporting block 27 which does not affect the charging action, as indicated by solid lines in FIG. 3, but when the corona discharging device has been mounted in the image forming apparatus with the cleaner 20 being for example, in a position indicated by dots-and-dash lines in FIG. 3, irregularity of charging will occur in the portion wherein the cleaner 20 is positioned. That is, not only the area to be charged is shielded by the cleaner 20, but also the cleaning portion 25 of the cleaner 20 is in contact with the wire 14 with a predetermined pressure force and therefore, in that portion, the distance between the wire 14 and the image bearing member 1 varies and uniform charging becomes impossible.

So, in the present invention, to prevent such a situation, a stopper 36 is provided on a portion of the support member 32 which supports the corona discharging device 10. Thus, even if the corona discharging device 10 is mounted in the image forming apparatus body with the cleaner 20 being not in a predetermined home position (in the present embodiment, the position indicated by solid lines in FIG. 3), for example, with the cleaner 20 being placed in a position indicated by dots-and-dash line 20' in FIG. 3, the knob portion 22 of the cleaner 20 bears against said stopper 36 with the insertion of the corona discharging device and the cleaner 20 is moved relative to the corona discharging electrode in the direction opposite to the direction of insertion of the corona discharging device, whereby the corona cleaner 20 is returned to said predetermined position. Accordingly, even if the operator forgets to move the cleaner 20 to the solid line position of FIG. 3 after the corona discharging wire has been cleaned, the cleaner 20 can always be relatively moved to the solid line position of FIG. 3 with the insertion of the corona discharging device into the image forming apparatus. Therefore, the inconvenience that irregularity of charging occurs as described above can be reliably eliminated.

Also, when the cleaner 20 is in a position indicated by solid lines in FIG. 3 (in the present embodiment, this position is the home position of the cleaner 20), if the corona discharging wire 14 remains in contact with the cleaning portion 25 of the cleaner 20, it will be difficult to effect positioning such as height adjustment of the corona discharging wire 14. So, in the present embodiment, the front insulative supporting block 27 is provided with an inclined portion **27*b* as shown in FIG. 3. The projection 26*a* (FIG. 2) of the holding portion 26 of the cleaner 20 is guided by this inclined portion 27*b* and the holding portion 26 is moved away from the wire 14 against the resilient force of the resilient arm portion 24. Thus, the cleaning portion 25 of the cleaner 20 is spaced apart from the corona discharging wire 14 when the corona discharging wire 14 is not being cleaned, that is, when the cleaner 20 is in the solid line position of FIG. 3**.

Figure 4:
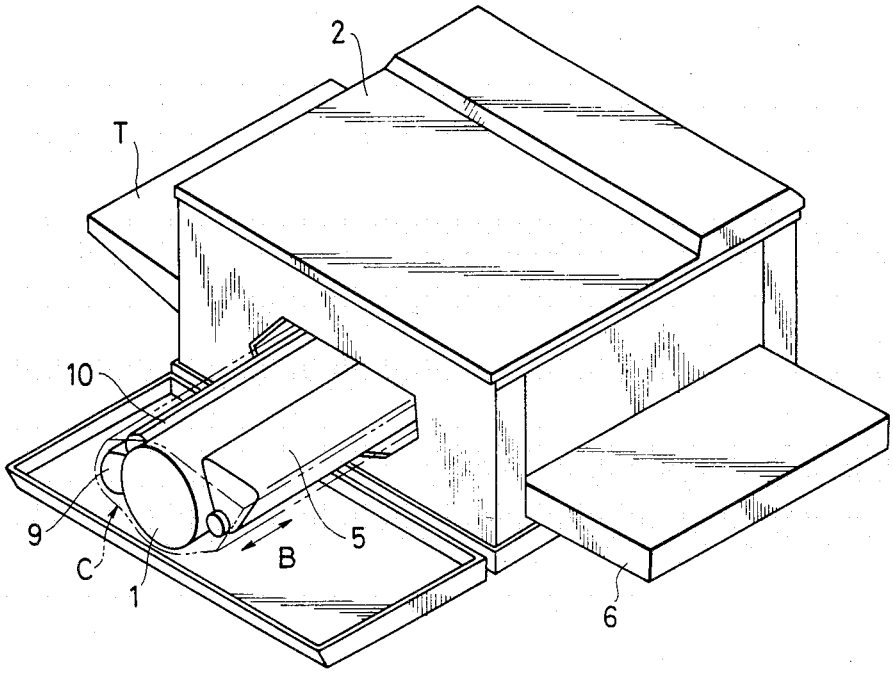
FIG. 4 is a schematic perspective of an image forming apparatus showing a second embodiment of the present invention.
Figure 5:
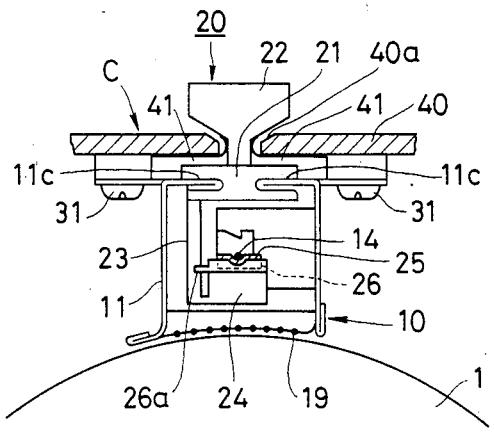
FIG. 5 is a schematic transverse cross-sectional view of the vicinity of a corona discharging device showing the second embodiment of the present invention.

The embodiment in which the corona discharging device is removably mountable with respect to the image forming apparatus body has been described above, and a second embodiment of the present invention will now be described by reference to FIGS. 4, 5 and 6.

The present embodiment is such that various process means for image formation such as an image bearing member 1, a corona discharging device 10, a developing device 5 and a cleaning device 9 are contained as a unit in a cartridge C (indicated by dots-and-dash lines) which is removably mountable in the directions of bilateral arrow B (FIG. 4) with respect to the image forming apparatus body. The means to be contained in the cartridge C are not always limited to those of the present embodiment, but any process means may be selected and contained in the cartridge C. For example, design may be made such that the image bearing member 1, the corona discharging device 10 and the cleaning device 9 are contained in the cartridge and the developing device 5 is separately made removably mountable with respect to the image forming apparatus. If this is done, supply of developer will become possible by interchanging only the developing device. Also, in some cases, design may be made such that each process means in the cartridge is individually removably mountable with respect to the cartridge.

Description will now be made of the corona discharging device in the cartridge C. In this corona discharging device, members functionally similar to those of the corona discharging device described in connection with FIGS. 2 and 3 are given similar reference numerals.

The corona discharging device 10 is fixed to the frame member 40 of the cartridge C by means of fixing members such as screws 31. The slide portion 21 of the cleaner 20 is movable lengthwise relative to the corona discharging wire with an opening 11C, opposite the discharge opening of the shield member 11 of the corona discharging device 10, functioning as a guide portion. The knob portion 22 of the cleaner 20 protrudes to the outside of the frame member 40 through the slit opening **40*a* of the frame member 40**. In the other points, the construction of the cleaner is similar to what has been previously described.

Also, a flexible light-intercepting sheet 41, such as a black MYLAR polyester sheet (MYLAR is a trademark of the E. I. DuPont De Nemours & Company) or a rubber sheet, is provided in the slit opening **40*a* of the cartridge to prevent entry of extraneous light and dust. This light-intercepting sheet is formed with a cut so as to permit movement of the cleaner 20 and is adhesively secured to the inner side of the frame member 40** of the cartridge.

Now, in the present embodiment, the corona discharging device is fixed to the frame member of the cartridge and therefore, it is not possible to pull out the corona discharging device to effect cleaning of the wire as is the case with the previously described corona discharging device. Accordingly, in the present embodiment, the cartridge is pulled out of the image forming apparatus body, whereafter the cleaner is reciprocally moved along the slit opening of the frame member of the cartridge to thereby effect cleaning of the wire.

Figure 6:
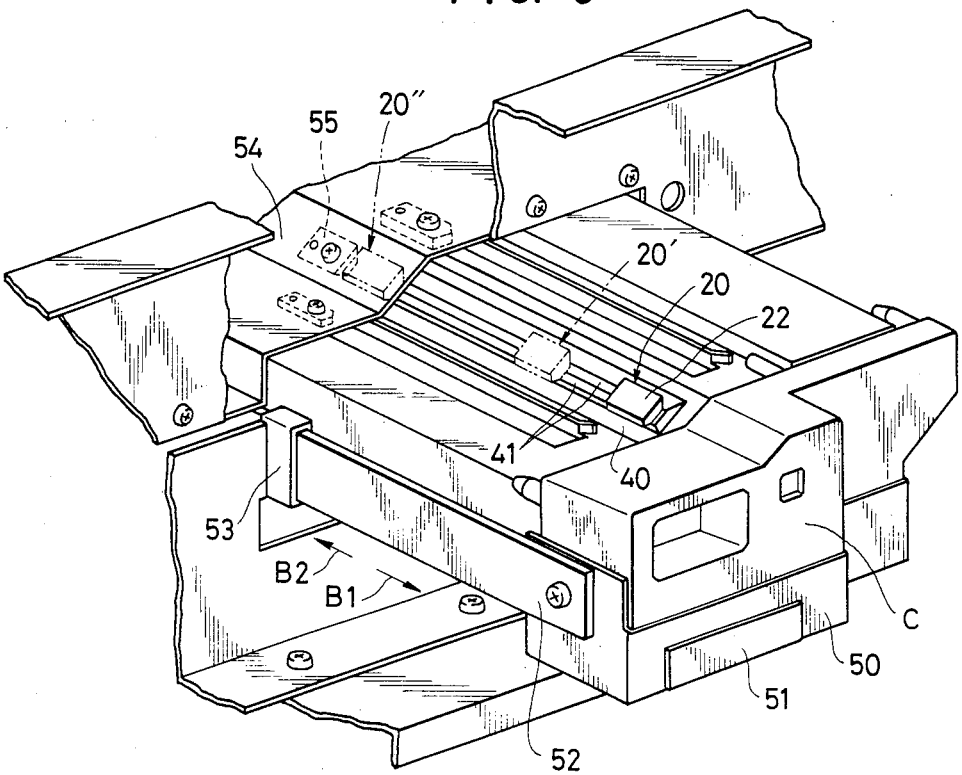
FIG. 6 is a perspective view of a cartridge partly pulled out of the image forming apparatus body.

FIG. 6 shows the cartridge C partly pulled out of the image forming apparatus body. The cartridge C is supported by a support frame 50 (the inner side of which is not shown) and a rail 52 (the right side of which is not shown) mounted on the support frame 50. The rail 52, in order to permit the cartridge C to be contained in the apparatus body, is engaged with a guide portion 53 (the right side of which is not shown) formed on the frame member of the apparatus body so that it is slidable in the directions of arrows B1 and B2.

To separate the cartridge C from the image forming apparatus body, the cartridge C is drawn out from its state in which it is mounted in the apparatus body, in the direction of arrow B1 by gripping the handle portion 51 of the support frame 50 and the is completely drawn out, whereafter the cartridge C is removed upwardly from the support frame 50. On the other hand, to mount the cartridge C in the image forming apparatus body, the cartridge C may be placed onto the support frame 50, whereafter the support frame 50 may be pushed in the direction of arrow B2.

The supporting of the cartridge C is not limited to what has been described above, but design may also be made such that a rail portion is provided in the frame member of the cartridge C, a guide portion adapted to be engaged with this rail portion being provided on the apparatus body side and the cartridge C being directly removably mountable with respect to the apparatus body.

Also, it is to be understood that the cleaner 20 of the corona discharging device when not in use is placed at the end on this side of the slit opening 40*a* of the cartridge C as indicated by solid lines in FIG. 6. In the present embodiment, this position is the home position of the cleaner 20. This position is a position which does not affect at least the charging action of the corona discharging device.

Now, if the cartridge C is mounted in the apparatus body with the cleaner 20 remaining not in the home position but in the position indicated by dots-and-dash line 20' in FIG. 6 after the cartridge C has been removed from the apparatus body and the wire has been cleaned by the cleaner 20, there will occur an inconvenience, that as in the case of the previously described embodiment, irregularity of charging occurs in the portion wherein the cleaner 20 is placed.

So, in the present embodiment, a stopper 55 adapted to be engaged with the knob portion 22 of the cleaner 20 is provided on the frame member 54 of the apparatus body. Accordingly, even if the cartridge C is mounted in the apparatus body with the cleaner 20 remaining in the position indicated by dots-and-dash line 20' in FIG. 6, the knob portion 22 of the cleaner 20 comes to bear against the stopper 55 as indicated by dots-and-dash line 20'' in FIG. 6 as the cartridge C is pushed in the direction of arrow B2, whereby movement of the cleaner 20 is controlled. Therefore, with the insertion of the cartridge C into the apparatus body, the cleaner 20 is moved relative to the corona discharging electrode in the direction of arrow B1 which is opposite to the direction of insertion of the cartridge C, and is thereby relatively returned to a predetermined home position. Accordingly, in whatever position the cleaner 20 is placed, the cleaner 20 can be relatively moved to the home position which does not affect the charging action, with the insertion of the cartridge C into the apparatus body. Thus, the inconvenience as previously mentioned does not occur.

Design is made such that when the cleaner 20 is in the home position, the cleaning portion of the cleaner 20 is spaced apart from the wire as in the case of the corona discharging device described in connection with FIGS. 2 and 3. Thus, no unreasonable pressure force acts on the wire and accordingly, uniform charging can be accomplished.

Figure 7:
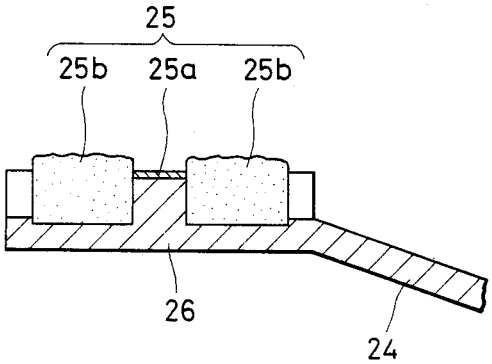
FIG. 7 is a cross-sectional view showing a modification of the cleaner.

Now, the material of the cleaning portion of the cleaner described in the previous embodiment may preferably be a flexible material such as felt, but is required to have an ozone-resisting property and a nap fall-off preventing property and thus may desirably be felt made of polyester fiber or polyurethane fiber. Also, the stain of the wire by the additive of toner, particularly silica or the like, is hard to remove and therefore, as shown in FIG. 7, sand paper 25*a* (of the order of #1000 or more) may be provided on the cleaning portion 25 so that it is applied to the wire and felt materials 25*b* may be provided forwardly and rearwardly of the sand paper to wipe off the scraped powder. Alternatively, felt may be folded so as to sandwich the wire in order to improve the cleaning.

According to the present invention, as described above, the operator can accomplish the cleaning of the corona discharging electrode without directly touching it. Also, by the stopper being provided, forgetting to return the cleaner to the home position can be reliably prevented.

What we claim is:

1. An image forming apparatus comprising:

a removably mountable corona discharging device having a corona discharging electrode and cleaning means for cleaning said corona discharging electrode;

guide means for guiding said corona discharging device when said corona discharging device is removably mounted in an operative position; and stopper means adapted to be engaged with said cleaning means and to move said cleaning means relative to said corona discharging electrode in the direction opposite to the direction of movement of said corona discharging device when said corona discharging device is mounted in said operative position and when said cleaning means is not positioned at a predetermined position in said corona discharging device, thereby to move said cleaning means to said predetermined position, said stopper means being disposed inside of a containing portion for containing said corona discharging device therein;

wherein said cleaning means is contained in said containing portion when said corona discharging device is mounted at said operative position.

2. An image forming apparatus according to claim 1, wherein said cleaning means of said corona discharging device is movable lengthwise relative to said corona discharging electrode.

3. An image forming apparatus according to claim 1, further including spacing means for spacing the cleaning portion of said cleaning means apart from said corona discharging electrode when said cleaning means of said corona discharging device is positioned at said predetermined position in said corona discharging device.

4. An image forming apparatus according to any one of claims 1 to 3, further having a movable image bearing member subjected to a corona discharging process and wherein said guide means supports said corona discharging device for movement in a direction substantially orthogonal to the direction of movement of said image bearing member.

5. An image forming apparatus according to claim 4, wherein when said cleaning means is not positioned at said predetermined position, said stopper means is engaged with said cleaning means in the course of movement of said corona discharging device toward said operative position to thereby stop and hold said cleaning means at said predetermined position.

6. An image forming apparatus comprising:

a removably mountable cartridge having image formation process means provided with at least corona discharging means with a corona discharge electrode and cleaning means for cleaning said corona discharging electrode;

guide means for guiding said cartridge when said cartridge is mounted and dismounted with respect to said image forming apparatus; and stopper means adapted to be engaged with said cleaning means and to move said cleaning means relative to said corona discharging electrode in the direction opposite to the direction of movement of said cartridge when said cartridge is mounted in said image forming apparatus when said cleaning means is not positioned at a predetermined position in said cartridge, thereby to move said cleaning means to said predetermined position, said stopper means being disposed inside of a containing portion for containing said cartridge therein;

wherein said cleaning means is contained in said containing portion when said cartridge is mounted in said image forming apparatus.

7. An image forming apparatus according to claim 6, wherein said cartridge has a slit-like opening parallel to said corona discharging electrode, and said cleaning means is supported by said cartridge for movement along said slit-like opening lengthwise relative to said corona discharging electrode.

8. An image forming apparatus according to claim 7, wherein said cartridge has a light-intercepting sheet member along said slit-like opening.

9. An image forming apparatus according to claim 6, further including spacing means for spacing the cleaning portion of said cleaning means apart from said corona discharging electrode when said cleaning means is positioned at said predetermined position in said cartridge.

10. An image forming apparatus according to any one of claims 6 to 9, wherein said guide means supports said cartridge for movement relative to said image forming apparatus lengthwise relative to said corona discharging electrode.

11. An image forming apparatus according to claim 10, wherein when said cleaning means is not positioned at said predetermined position, said stopper means is engaged with said cleaning means in the course of insertion of said cartridge into said image forming apparatus to thereby stop and hold said cleaning means at said predetermined position.

* * * * *